US006053448A

United States Patent [19]

Sakamoto

[11] Patent Number: 6,053,448

[45] Date of Patent: Apr. 25, 2000

[54] COIL BOBBIN AND WINDING JIG FOR USE IN FORMING A WOUND COIL AND METHOD OF WINDING A WIRE ON THE COIL BOBBIN

[75] Inventor: Yuki Sakamoto, Isesaki, Japan

[73] Assignee: Sanden Corporation, Gunma, Japan

[21] Appl. No.: 09/057,540

[22] Filed: Apr. 9, 1998

[30] Foreign Application Priority Data

Apr. 9, 1997 [JP] Japan ..... 9-090554

[51] Int. Cl.[7] ..... B21C 47/02; B65H 81/06

[52] U.S. Cl. ..... 242/443; 242/448; 242/608.2; 242/596.7; 242/597.6; 242/599.1; 242/599.2

[58] Field of Search ..... 242/447.1, 443, 242/448, 608, 608.2, 608.8, 597.6, 596.7, 599.1, 599.2, 599.4, FOR 110

[56] References Cited

U.S. PATENT DOCUMENTS 2,709,051 5/1955 Bunch .

FOREIGN PATENT DOCUMENTS

| | | |
|---|---|---|
| 0222426 | 5/1987 | European Pat. Off. . |
| 2263048 | 10/1975 | France . |
| 843436 | 7/1952 | Germany . |
| 5258940 | 10/1993 | Japan . |
| 3515 | 1/1914 | United Kingdom . |
| 2123617 | 2/1984 | United Kingdom . |

*Primary Examiner*—Donald P. Walsh
*Assistant Examiner*—Emmanuel M. Marcelo
*Attorney, Agent, or Firm*—Baker & Botts, L.L.P.

[57] ABSTRACT

In a coil bobbin for use in forming a wound coil, a plurality of open portions are made to at least one of a first and a second flange which are outwardly extended from both axial ends of a tubular portion, respectively. The first and the second flange portions define a coil-placing region therebetween for placing the wound coil. The open portions permits insertion into the coil-placing region of an adjusting arrangement which is for adjusting an effective size of the coil-placing region in an axial direction of the tubular portion.

17 Claims, 5 Drawing Sheets

COIL BOBBIN AND WINDING JIG FOR USE IN FORMING A WOUND COIL AND METHOD OF WINDING A WIRE ON THE COIL BOBBIN

BACKGROUND OF THE INVENTION

The present invention relates to a technique of manufacturing a wound coil for use in, for example, an electromagnetic clutch which enables or disables transmission of the power to a compressor in an automobile air conditioner. More particularly, this invention relates to a coil bobbin and a winding jig for use in forming the wound coil and a method of winding a wire on the coil bobbin.

Upon forming a coil by winding a wire, a coil bobbin may be used or may not be used.

When the coil bobbin is not used for forming the coil, the wire is directly wound around a jig to obtain the wound wire which is then detached from the jig in this state. Thereafter, for keeping the wound wire in shape, an insulating tape is twined around the wound wire at some portions thereof or along the whole circumference thereof, and then a cotton tape is further wound thereon.

On the other hand, when the coil bobbin is used for forming the coil, the wire is wound around the coil bobbin to obtain the wound wire which is then temporarily retained using a tape or the like.

In the former case, since the operation of twining the insulating tape around the wound wire is troublesome, the production thereof is not easy. Further, since the wound wire easily gets out of shape and the insulation property is poor, the low reliability is resulted. On the other hand, in the latter case, since the operation of twining the insulating tape is not required and further the wound wire does not get out of shape so that it is excellent in insulation property, the high reliability is resulted. In view of this, the coils using the coil bobbins have been dominant recently.

The conventional coil bobbins are generally made of nylon resin. The coil bobbin comprises a tubular portion, a first flange portion outwardly extended from one axial end of the tubular portion and a second flange portion outwardly extended from the other axial end of the tubular portion. The outer periphery of the tubular portion and the inner surfaces of the first and second flange portions define a wire winding region or a coil-placing region where the wire is wound.

The conventional coil bobbins are classified into a first and a second type. In the first type, the outer periphery of the tubular portion is formed with grooves for facilitating the wire winding as disclosed, for example, in JP-A-5-258940. In the second type, the outer periphery of the tubular portion is not formed with a means for facilitating the wire winding.

When the coil bobbin of the second type is used, it is difficult to wind the wire in an orderly manner so that the disorder in winding is resulted. For preventing an occurrence of the winding disorder, the dimensions of the wire winding region, particularly a width (an interval between the inner surface of the first flange portion and the inner surface of the second flange portion) thereof, are important. Since an adjustment of the width is not possible in the coil bobbin, the width of the coil bobbin should be achieved in advance with high accuracy. However, since the coil bobbins are generally made of nylon resin, the dimensional accuracy is not so high. For enhancing the dimensional accuracy, the production cost is increased.

On the other hand, the coil bobbin of the first type has the following problem. Specifically, on metal molds for forming the coil bobbins of this type, concave-convex portions are provided for forming the grooves. When the resin is poured into the metal molds, the concave-convex portions are abraded due to friction between the concave-convex portions and the resin. The abrasion of the concave-convex portions is particularly severe on joining surfaces of the metal molds so that the metal molds become unusable immediately. Accordingly, the life duration of the metal molds is short and thus the high production cost of the coil bobbin is resulted.

SUMMARY OF THE INVENTION

It is therefore an object of the present invention to provide an improved coil bobbin that can eliminate one or more of the foregoing problems.

It is another object of the present invention to provide an improved wire winding method that can eliminate one or more of the foregoing problems.

Other object of the present invention will become clear as the description proceeds.

According to one aspect of the present invention, there is provided a coil bobbin for use in forming a wound coil. The coil bobbin comprises a tubular portion having a first and a second axial end opposite to each other in a predetermined direction, a first flange portion outwardly extended from the first axial end, and a second flange portion outwardly extended from the second axial end. The first and the second flange portions defines a coil-placing region therebetween for placing the wound coil. In the coil bobbin, at least one of the first and the second flange portions has a plurality of open portions permitting insertion into the coil-placing region of adjusting means which is for adjusting an effective size of the coil-placing region in the predetermined direction.

According to another aspect of the present invention, there is provided a winding jig for use in forming a wound coil on a coil bobbin which comprises a tubular portion having a first and a second axial end opposite to each other in a predetermined direction, a first flange portion outwardly extended from the first axial end, and a second flange portion outwardly extended from the second axial end, the first and the second flange portions defining a coil-placing region therebetween for placing the wound coil, at least one of the first and the second flange portions having a plurality of open portions facing the coil-placing region in the predetermined direction. The winding jig comprises a first jig having a first support portion which is for confronting the first flange portion, and a second jig having a second support portion which is for confronting the second flange portion. In the winding jig, at least one of the first and the second jigs comprises adjusting means which is inserted in the coil-placing region through the open portions and is for adjusting an effective size of the coil-placing region in the predetermined direction.

According to still another aspect of the present invention, there is provided a wire winding method comprising the steps of preparing a coil bobbin which comprises a tubular portion having a first and a second axial end opposite to each other in a predetermined direction, a first flange portion outwardly extended from the first axial end, and a second flange portion outwardly extended from the second axial end, the first and the second flange portions defining a coil-placing region therebetween for placing the wound coil, at least one of the first and the second flange portions having a plurality of open portions facing the coil-placing region in the predetermined direction, preparing a first jig having a first support portion and a plurality of protruded portions protruded from the first support portion, preparing a second jig having a second support portion, interposing the coil bobbin between the first and second support portions with the protruded portions being inserted into the coil-placing region through the open portions to adjust an effective size of the coil-placing region in the predetermined direction, and winding a wire around the tubular portion in the coil-placing region.

BRIEF DESCRIPTION OF THE DRAWING

FIGS. 1A–1C show a coil bobbin according to a preferred embodiment of the present invention, wherein FIG. 1A is a front end view, FIG. 1B being a side view, FIG. 1C being a rear view;

FIGS. 2A–2E show portions of the coil bobbin shown in FIGS. 1A–1C, respectively, wherein FIG. 2A is an enlarged diagram of a portion A in FIG. 1A, FIG. 2B being a sectional view taken along line B—B in FIG. 1A, FIG. 2C being a sectional view taken along line C—C in FIG. 1A, FIG. 2D being a sectional view taken along line D—D in FIG. 1C, FIG. 2E being a sectional view taken along line E—E in FIG. 1C;

FIGS. 3A–3F show a winding jig according to a preferred embodiment of the present invention, wherein FIG. 3A is a front view of a first jig, FIG. 3B being a side view of the first jig, FIG. 3C being a front view of a second jig, FIG. 3D being a side view of the second jig, FIG. 3E being a front view of a shim, FIG. 3F being a side view of the shim;

FIGS. 4A and 4B show a wire winding method according to a preferred embodiment of the present invention, wherein FIG. 4A is a side view showing a state before attaching the coil bobbin to the wire winding jig, and FIG. 4B is a side view showing a state wherein the coil bobbin is attached to the wire winding jig;

DESCRIPTION OF THE PREFERRED EMBODIMENT

Figure 1C:
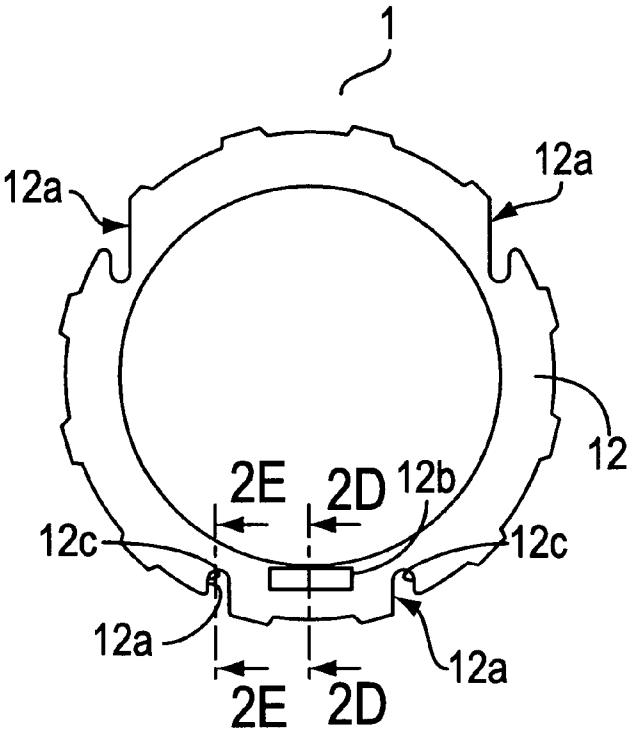
Figure 1B:
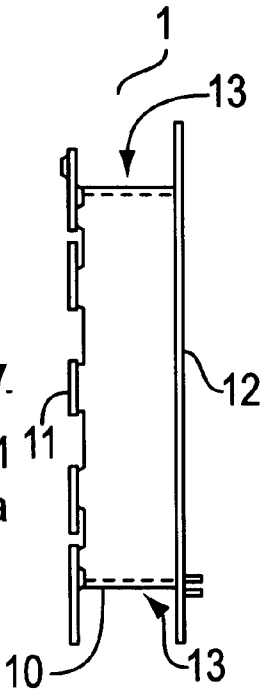
Figure 1A:
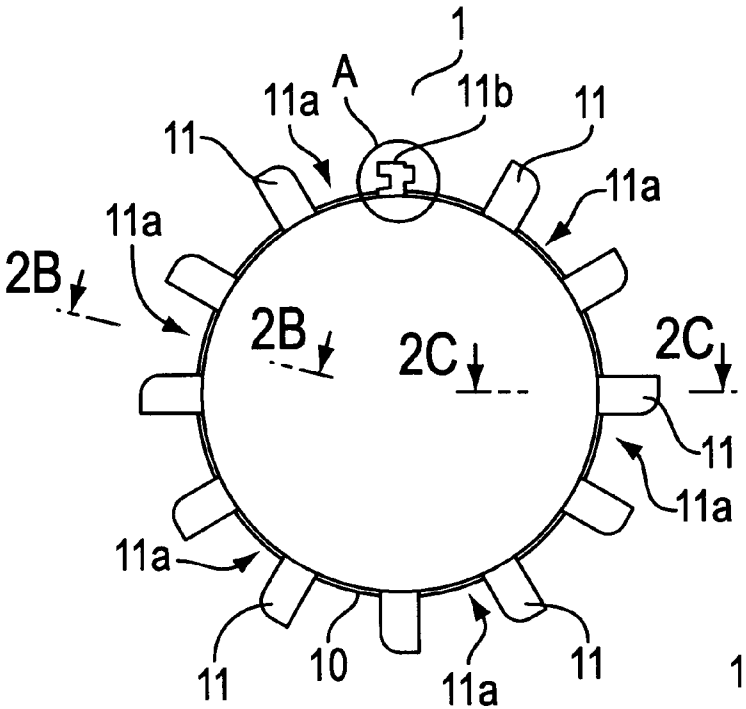
Figure 2A:
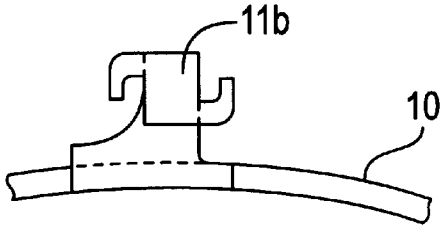
Figure 2B:
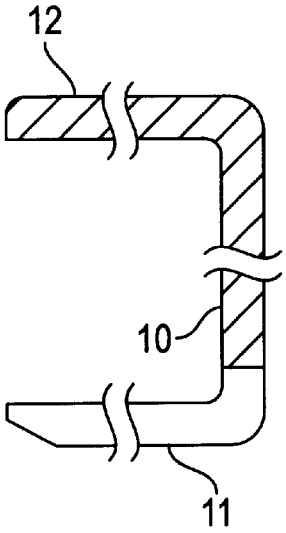
Figure 2C:
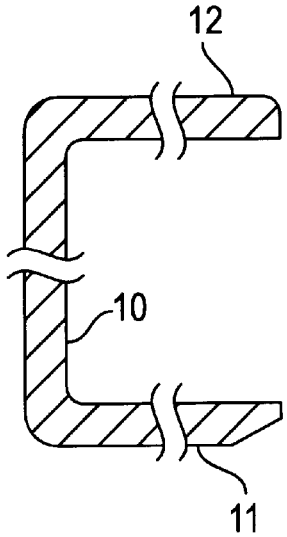
Figure 2D:
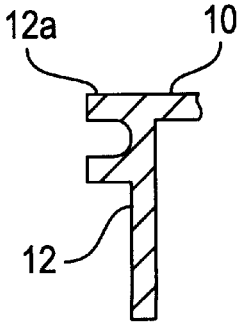
Figure 2E:
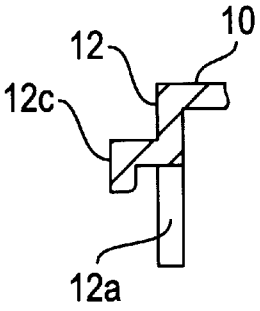
Figure 3A:
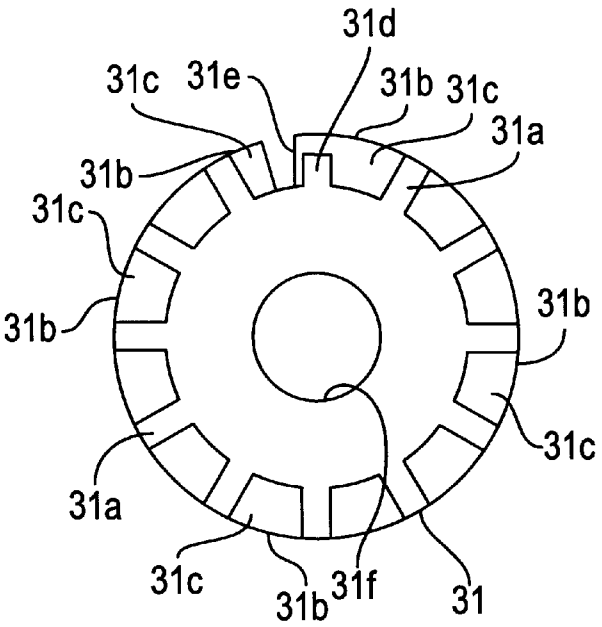
Figure 3B:
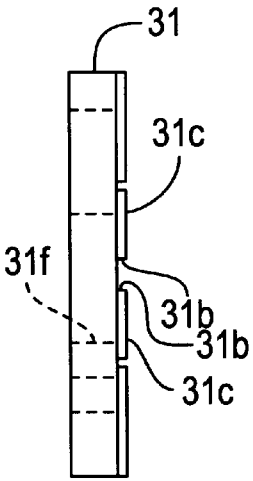
Figure 3C:
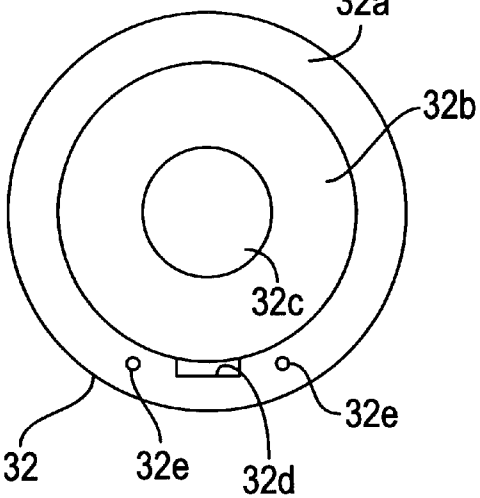
Figure 3D:
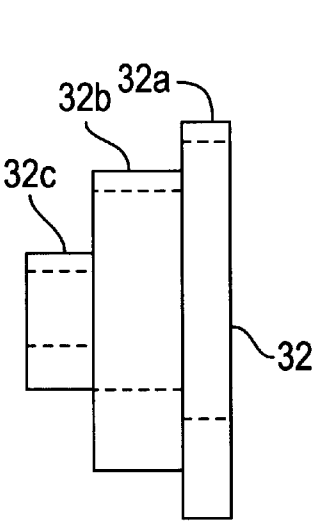
Figure 3E:
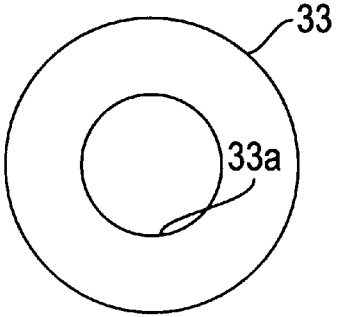
Figure 3F:
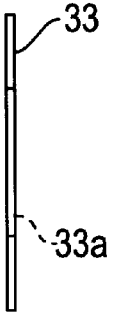

Referring to FIGS. 1A–1C and 2A–2E, description will be made as regards a coil bobbin according to a preferred embodiment of this invention. The coil bobbin is designated by a reference numeral 1 and comprises a tubular portion 10 having a first and a second axial end in a predetermined direction, a first flange portion 11 outwardly extended from the first axial end of the tubular portion 10, and a second flange portion 12 outwardly extended from the second axial end of the tubular portion 10.

The coil bobbin 1 is integrally formed of nylon resin. The tubular portion 10 is essentially cylindrical. Nothing is formed on the outer periphery of the tubular portion 10.

The first flange portion 11 has a plurality of open portions or wide slits 11*a* at regular intervals except at an upper end portion of the first flange portion 11. In other words, the open portions are placed around a central axis of the tubular portion to have a predetermined angle therebetween. Each of the slits 11*a* inwardly extends from an outer periphery thereof to the tubular portion 10. As a result of providing the slits 11*a*, the first flange portion 11 is divided into a plurality of finger portions radially outwardly protruded from the first axial end of the tubular portion 10.

In the slit 11*a* provided at the upper end portion of the first flange portion 11, a lead-retaining portion 11*b* is provided for retaining a first lead or a winding start end of a wire 2 (see FIG. 6) and further retaining a second lead or a winding finish end of the wire 2 drawn out from a wire winding region or a coil-placing region 13 which will later be described.

The second flange portion 12 is formed with four cutouts 12*a*. At a lower part of the second flange portion 12 is provided a fuse-retaining portion 12*b* for retaining a fuse (not shown) connected in series to the wire 2. At both sides of the fuse-retaining portion 12*b*, projections 12*c* are provided for retaining leads of the fuse.

An outer periphery of the tubular portion 10, an inner surface of the first flange portion 11, and an inner surface of the second flange portion 12 define a wire winding region 13 of an essentially ring shape in cooperation with one another.

Referring to FIGS. 3A–3F, the description will be made as regards a winding jig according to a preferred embodiment of this invention. The wire winding jig is used for winding the wire 2 on the coil bobbin 1 and comprises the first jig 31, the second jig 32, and the shim 33.

The first jig 31 has an essentially disk shape. A ring-shaped region of the first jig 31 at an outermost peripheral portion thereof forms a first support portion 31*a*. In a use state (see FIG. 4B), the first support portion 31*a* confronts the first flange portion 11 of the coil bobbin 1 with a slight gap therebetween and supports the first flange portion 11 in a thickness direction (see FIG. 5).

The first support portion 31*a* is formed with a plurality of convex portions 31*b* corresponding to the slits 11*a* of the coil bobbin 1. In other words, the convex portions 31*b* are protruded from the first support portion 31*a* in the thickness direction and may be referred to as protruded portions. The convex portions 31*b* are placed around the central axis to have the predetermined angle therebetween.

In the use state, the convex portions 31*b* are fitted into the slits 11*a* so that one end of each convex portion 31*b* in a thickness direction protrudes into the wire winding region 13. One end surface of each convex portion 31*b* in the thickness direction is formed as a flat surface 31*c*. In the use state, the flat surfaces 31*c* enter the wire-winding region 13 so as to define portions of the true-wire winding region 13' (see FIG. 5), where the wire 2 is actually wound, instead of the inner surface of the first flange portion 11 of the coil bobbin 1. In other words, a combination of the convex portions 31*b* is referred as an adjusting arrangement which is for adjusting an effective size of the wire-winding region 13 in the predetermined direction.

The convex portion 31*b* provided at an upper end portion of the first jig 31 is formed with a concave portion 31*d* recessed in the thickness direction of the first support portion 31*a* for receiving therein the wire retaining portion 11*b* of the coil bobbin 1 in the use state. Further, the first support portion 31*a* is formed at its upper end portion with a cutout portion 31*e* for receiving the winding start end and the winding finish end of the wire 2 that is connected to the wound coil. The first jig 31 is further formed at its center with a fitting hole 31*f*.

The second jig 32 comprises a second support portion 32*a*, a third support portion 32*b*, and a fitting portion 32*c*. The second support portion 32*a* has an essentially disk shape. In the use state, the second support portion 32*a* confronts the second flange portion 12 of the coil bobbin 1 in an abutting state so as to support the second flange portion 12 in the predetermined direction (see FIG. 5). At a lower part of the second support portion 32*a*, concave portions 32*d* and 32*e* are provided for receiving therein the fuse-retaining portion 12*b* and the projections 12*c* of the coil bobbin 1, respectively.

The third support portion 32*b* has an essentially disk shape which is thicker and of a smaller diameter as compared with the second support portion 32*a*, and is coaxial with the second support portion 32*a*. The third support portion 32*b* is fitted into the tubular portion 10 of the coil bobbin 1 so as to support the coil bobbin 1 as a whole.

The fitting portion 32*c* has an essentially disk shape which is smaller in diameter than the third support portion 32*b* and thicker than the first jig 31, and is coaxial with the third support portion 32*b*. The fitting portion 32*c* is fitted into the fitting hole 31*f* of the first jig 31 so that the first jig 31 and the second jig 32 are combined with each other.

Accordingly, by mounting the coil bobbin 1 on the third support portion 32*b* of the second jig 32 and then inserting the fitting portion 32*c* into the fitting hole 31*f*, the coil bobbin 1 is disposed in position between the first jig 31 and the second jig 32. In this state, the wire winding is carried out.

The shim 33 is interposed or inserted between the first jig 31 and the third support portion 32*b* of the second jig 32. The shim 33 is formed at its center with a circular aperture 33*a*. By adjusting a thickness of the shim 33, a width (see W3 in FIG. 5) from the flat surfaces 31*c* of the convex portions 31*b* of the first jig 31 to an inner surface of the second support portion 32*a* of the second jig 32 can be delicately adjusted. Following this, a width W2 can also be adjusted.

Referring to FIGS. 4A, 4B, 5, and 6, the description will be directed to a wire winding method according to a preferred embodiment of the present invention. The wire winding method is carried out by the use of the coil bobbin 1 and the winding jig that is designated by the reference numeral 3 in FIGS. 5 and 6.

Figure 4A:
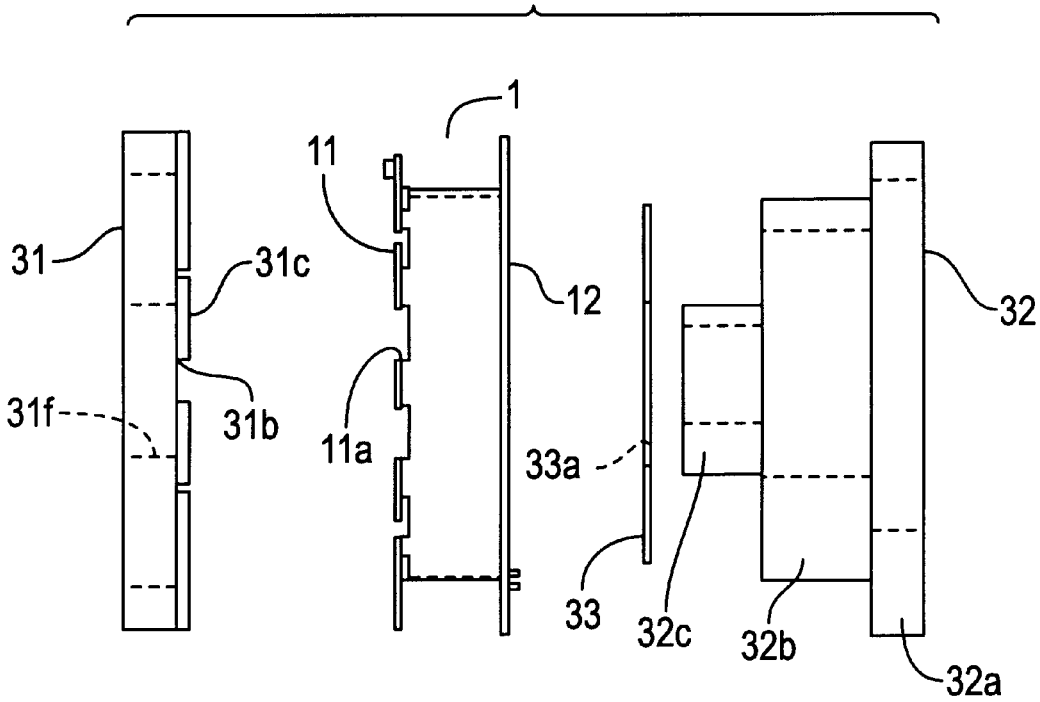
Figure 4B:
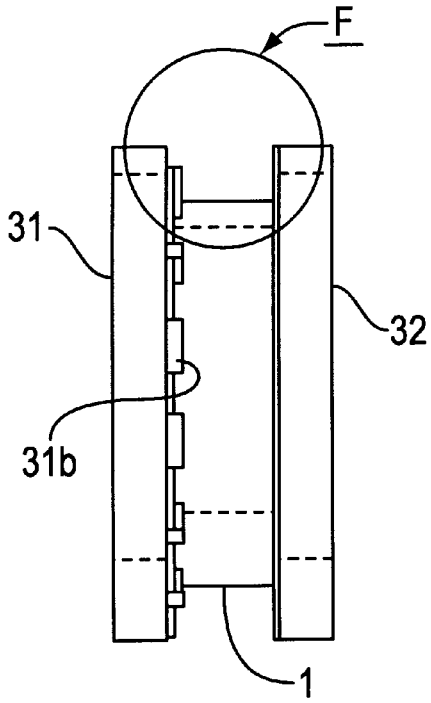

First, the coil bobbin 1 and the shim 33 are disposed between the first jig 31 and the second jig 32 as shown in FIG. 4A. From this state, the third support portion 32*b* of the second jig 32 is inserted into the tubular portion 10 of the coil bobbin 1, then the fitting portion 32*c* of the second jig 32 is inserted into the circular aperture 33*a* of the shim 33, and then the fitting portion 32*c* is inserted into the fitting hole 31*f* of the first jig 31 while fitting the convex portions 31*b* of the first jig 31 into the slits 11*a* of the coil bobbin 1. As a result, the state shown in FIG. 4B is achieved.

The winding jig 3 further comprises a plurality of axial movement preventing arrangements 34 for preventing the coil bobbin 1 from movement thereof towards the first support portion 31*a* in the thickness direction thereof. The axial movement preventing arrangements 34 are placed around the central axis to have a uniform angle therebetween. Each of the axial movement preventing arrangements 34 comprises a movable element 34*a* assembled to the first support portion 31*a* to be movable in the thickness direction and a compressed coil spring 34*b* for pressing the movable element 34*a* to be brought in press contact with the tubular portion 10 of the coil bobbin 1 in the thickness direction.

In this state, the wire winding is carried out. As appreciated, if the, wire winding jig 3 is not used, the wire 2 is wound in the wire winding region 13 defined by the outer periphery of the tubular portion 10 and the inner surfaces of the first and second flange portions 11 and 12.

Figure 5:
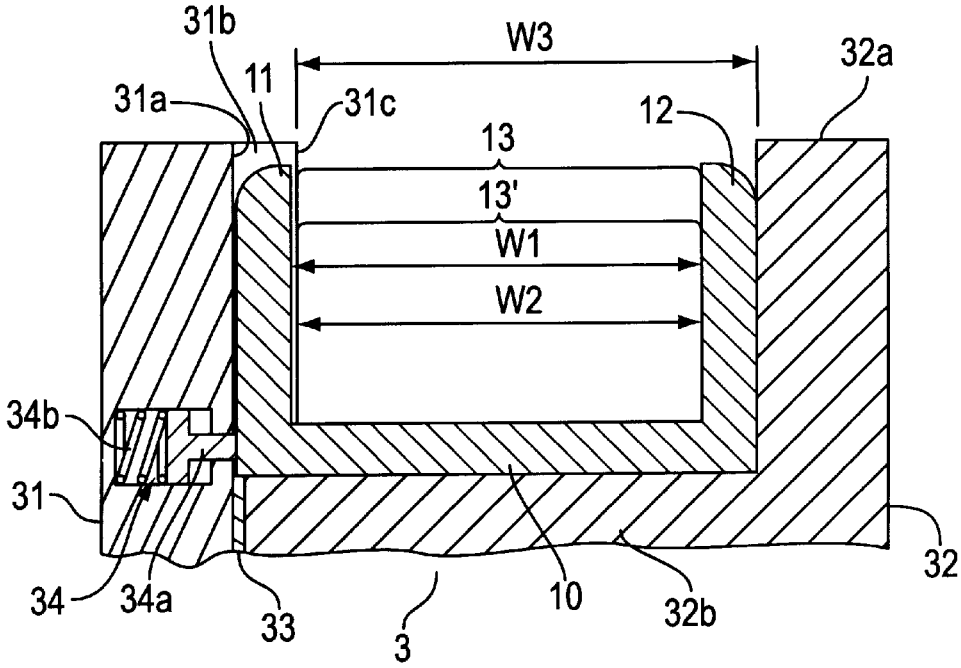
FIG. 5 is an enlarged sectional view of a portion F in FIG. 4B.
Figure 6:
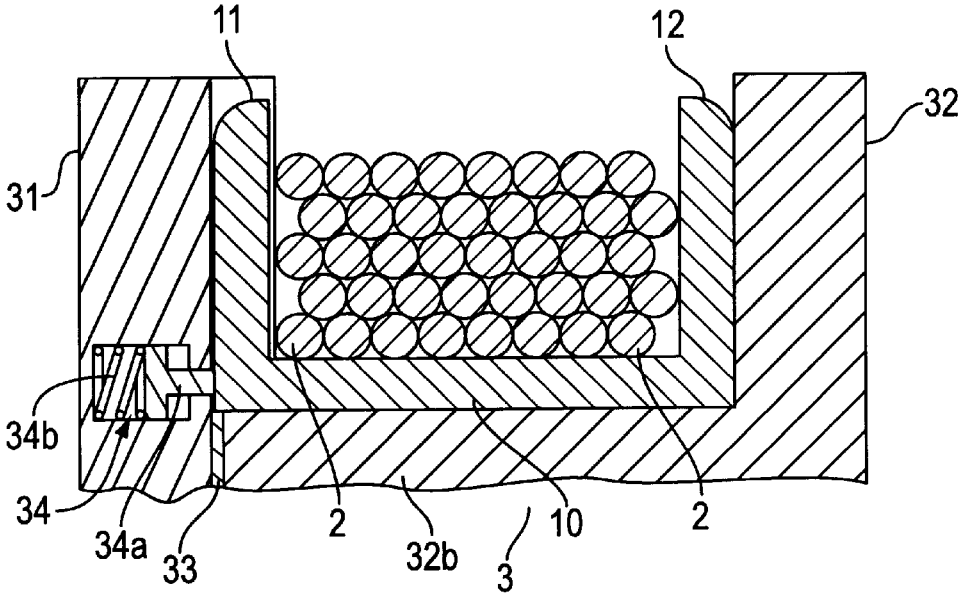
FIG. 6 is an enlarged sectional view of the portion F after a wire has been wound on the coil bobbin.

In the state where the first and second jigs 31 and 32 are attached to the coil bobbin 1 as shown in FIGS. 5 and 6, since the convex portions 31*b* of the first jig 31 protrude into the wire winding region 13 via the slits 11*a* of the coil bobbin 1, the wire 2 is actually wound in the true wire winding region 13' defined between the inner surface of the second flange portion 12 and the flat surfaces 31*c* of the convex portions 31*b*.

The high accuracy is required for the widths W1 and W2 of the wire winding regions 13 and 13'. This is because, for winding the wire 2 in orderly lines, the width of the wire winding region should be precisely set to be positive integer times a diameter of the wire 2. However, since the width W1 of the wire winding region 13 is determined by the inner surface of the first flange portion 11 and the inner surface of the second flange portion 12, the high accuracy can not be achieved due to deformation or the like of the first and second flange portions 11 and 12.

On the contrary, when the wire winding jig 3 is used, since the second flange portion 12 is pressed against the second support portion 32*a* of the second jig 32 by the wire 2 upon the wire winding, the width W2 of the wire winding region 13' is substantially determined by the width W3 from the flat surfaces 31*c* of the convex portions 31*b* of the first jig 31 to the inner surface of the second support portion 32*a* of the second jig 32.

In this manner, since the width W2 is essentially determined by the first jig 31 and the second jig 32, the accuracy of the width W2 can be essentially the same as that of the wire winding jig 3. Accordingly, the accuracy of the wire winding region 13' can be higher than that of the wire winding region 13, and further, the width W2 of the wire winding region 13' can be adjusted depending on a diameter of the wire 2.

As described above, when the wire winding is carried out using the wire winding jig 3, since the width W2 of the wire winding region 13' is highly accurate, the wire winding can be achieved in an orderly manner so that, as shown in FIG. 6, the winding disorder is not caused. After the completion of the wire winding, the wound wire may be bound using synthetic resin as conventionally carried out.

In the foregoing embodiments, the slits 11*a* are provided at the first flange portion 11. On the other hand, the slits may be provided at the second flange portion or at both the first and second flange portions. Similarly, the convex portions of the wire winding jig 3 may be provided at the second jig corresponding to the slits of the coil bobbin 1 or at both the first and second jigs.

According to the foregoing preferred embodiments, the winding disorder can be prevented so that the wire winding can be carried out in an orderly manner and further with low cost.

While the present invention has thus far been described in conjunction with a preferred embodiment thereof, it will be possible for those skilled in the art to put this invention into practice in various other manners. For example, through holes may be made as the open portions to at least one of the first and the second flange portions in place of the wide slits.

What is claimed is:

1. A coil bobbin system for use in forming a wound coil, comprising:

a coil bobbin comprising:

a tubular portion having a first and a second axial end opposite to each other in a predetermined direction;

a first flange portion outwardly extended from said first axial end; and a second flange portion outwardly extended from said second axial end, said first and said second flange portions defining a coil-placing region therebetween for placing said would coil; and, adjusting means for adjusting an effective size of said coil-placing region in said predetermined direction;

at least one of said first and said second flange portions having a plurality of open portions permitting insertion of said adjusting means.

2. A coil bobbin as claimed in claim 1, wherein each of said open portions radially and inwardly extends from an outer periphery of said at least one of said first and said second flange portions to form a slit.

3. A coil bobbin as claimed in claim 1, wherein said open portions are arranged around a central axis of said tubular portion so adjacent ones of said open portions have a predetermined angle therebetween.

4. A coil bobbin as claimed in claim 1, wherein said first flange portion has a lead-retaining portion for retaining a lead connected to said wound coil.

5. A coil bobbin as claimed in claim 1, wherein said second flange portion has a fuse-retaining portion for retaining a fuse connected in series to said wound coil.

6. A winding jig for use in forming a wound coil on a coil bobbin which comprises a tubular portion having a first and a second axial end opposite to each other in a predetermined direction, a first flange portion outwardly extended from said first axial end, and a second flange portion outwardly extended from said second axial end, said first and said second flange portions defining a coil-placing region therebetween for placing said wound coil, at least one of said first and said second flange portions having a plurality of open portions facing said coil-placing region in said predetermined direction, said winding jig comprising:

a first jig having a first support portion which is for confronting said first flange portion; and a second jig having a second support portion which is for confronting said second flange portion, at least one of said first and said second jigs comprising adjusting means which is inserted in said coil-placing region through said open portions and is for adjusting an effective size of said coil-placing region in said predetermined direction.

7. A winding jig as claimed in claim 6, wherein said first and said second jigs are combined to each other to interpose said coil bobbin therebetween.

8. A winding jig as claimed in claim 6, wherein said adjusting means comprises a plurality of protruded portions protruded from at least one of said first and said second support portions in said predetermined direction and inserted in said coil-placing region through said open portions to support said wound coil in said coil-placing region.

9. A winding jig as claimed in claim 8, wherein said protruded portions are arranged around said central axis so adjacent ones of said protruded portions have a predetermined angle therebetween.

10. A winding jig as claimed in claim 6, wherein said first support portion has a cutout portion for receiving therein a wire connected to said wound coil.

11. A winding jig as claimed in claim 6, wherein said first flange portion has a wire-retaining portion for retaining a wire connected to said wound coil, said first support portion having a concave portion for receiving said wire-retaining portion therein.

12. A winding jig as claimed in claim 6, wherein said second flange portion has a fuse-retaining portion for retaining a fuse connected in series to said wound coil, said second support portion having a concave portion for receiving said fuse-retaining portion therein.

13. A winding jig as claimed in claim 6, wherein said first jig has a fitting hole at a central portion thereof, said second jig comprising:

a third support portion coupled to said second support portion for being inserted in said tubular portion of the coil bobbin; and a fitting portion coupled to said third support portion for being fitted in said fitting hole.

14. A winding jig as claimed in claim 6, further comprising axial movement preventing means coupled to said first support portion and said first flange portion for preventing said coil bobbin from movement thereof towards said first support portion in said predetermined direction.

15. A wire winding method comprising the steps of:

preparing a coil bobbin which comprises a tubular portion having a first and a second axial end opposite to each other in a predetermined direction, a first flange portion outwardly extended from said first axial end, and a second flange portion outwardly extended from said second axial end, said first and said second flange portions defining a coil-placing region therebetween for placing said wound coil, at least one of said first and said second flange portions having a plurality of open portions facing said coil-placing region in said predetermined direction, preparing a first jig having a first support portion and a plurality of protruded portions protruded from said first support portion, preparing a second jig having a second support portion;

interposing said coil bobbin between said first and second support portions with said protruded portions being inserted into said coil-placing region through said open portions to adjust an effective size of said coil-placing region in said predetermined direction; and winding a wire around said tubular portion in said coil-placing region.

16. A wire winding method as claimed in claim 15, further comprising the step of inserting a shim between said first and said second support portions.

17. A wire winding method as claimed in claim 16, further comprising the step of preventing said coil bobbin from movement thereof towards said first support portion in said predetermined direction.

* * * * *